US006966280B1

(12) United States Patent
Carlson

(10) Patent No.: US 6,966,280 B1
(45) Date of Patent: Nov. 22, 2005

(54) COMPRESSION PULSE STARTING OF A FREE PISTON INTERNAL COMBUSTION ENGINE HAVING MULTIPLE CYLINDERS

(75) Inventor: Cliff Carlson, Fenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 17 days.

(21) Appl. No.: 10/841,924

(22) Filed: May 7, 2004

(51) Int. Cl.[7] ..... F02N 9/04

(52) U.S. Cl. ..... 123/46 R; 123/46 B; 123/51 R; 123/179.24; 123/179.31

(58) Field of Search ..... 123/46 R, 46 B, 123/51 R, 51 A, 179.24, 179.31, 185.14

(56) References Cited

U.S. PATENT DOCUMENTS

| | | | | |
|---|---|---|---|---|
| 3,358,656 | A * | 12/1967 | Panhard | 123/179.31 |
| 3,643,638 | A * | 2/1972 | Braun | 123/46 R |
| 3,722,481 | A * | 3/1973 | Braun | 123/46 R |
| 3,769,950 | A * | 11/1973 | Braun | 123/46 R |
| 4,372,256 | A * | 2/1983 | Firey | 123/46 A |
| 4,589,380 | A * | 5/1986 | Coad | 123/46 R |
| 4,694,791 | A * | 9/1987 | Tanaka | 123/179.31 |
| 5,213,067 | A | 5/1993 | Kramer | |
| 5,829,393 | A | 11/1998 | Achten et al. | |
| 6,105,541 | A | 8/2000 | Berlinger | |
| 6,135,069 | A | 10/2000 | Fenelon et al. | |
| 6,170,443 | B1 | 1/2001 | Hofbauer | |
| 6,206,656 | B1 | 3/2001 | Bailey et al. | |
| 6,279,517 | B1 | 8/2001 | Achten | |
| 6,318,309 | B1 | 11/2001 | Burrahm et al. | |
| 6,553,966 | B2 * | 4/2003 | Cornell et al. | 123/179.1 |
| 2003/0051682 | A1 | 3/2003 | Achten | |

OTHER PUBLICATIONS

Goertz et al., SAE Technical Paper Series 00-01-0996, Free Piston Engine Its Application and Optimization, Mar. 6-9, 2000, pp. 1-10.

Peter A.J. Achten, SAE Technical Paper Series 94-1776, A Review of Free Piston Engine Concepts, Sptember 12-14, 1994, pp. 1-12.

* cited by examiner

*Primary Examiner*—Erick Solis
(74) *Attorney, Agent, or Firm*—David B. Kelley; MacMillan, Sobanski & Todd

(57) ABSTRACT

A method for starting a free piston internal combustion engine that includes a first pair of mutually connected pistons, a second pair of mutually connected pistons, a first piston of each pair located in a first cylinder, a second piston of each pair located in a second cylinder. An air charge is supplied to a closed space in the cylinders, and the pistons are reciprocated to increase pressure of an air charge cyclically during successive cycles and to produce a predetermined pressure magnitude. Air and fuel are cyclically admitted to the first cylinder to produce repetitively a fuel-air mixture in the first cylinder. Cyclic combustion of the mixture in the first cylinder is produced, but a delay in applying to the engine at least a portion of an external load occurs until cyclic combustion of an air-fuel the mixture in the second cylinder occurs.

21 Claims, 5 Drawing Sheets

COMPRESSION PULSE STARTING OF A FREE PISTON INTERNAL COMBUSTION ENGINE HAVING MULTIPLE CYLINDERS

BACKGROUND OF THE INVENTION

The invention relates to internal combustion engines. In particular, the invention pertains to starting a free piston engine by cyclically increasing displacement of a piston that reciprocates due to pressure forces applied by an expanding and compressing air charge and an external periodic force applied by a actuator before ignition occurs.

A free piston internal combustion engine includes one or more reciprocating pistons located in a combustion cylinder. But there is no crankshaft mutually connecting the pistons and causing them to reciprocate when actuated by a starter-alternator, as in a conventional internal combustion engine. In a free piston engine running under normal operation, each piston moves during an expansion stroke in its cylinder in response to forces produced by combustion of an air-fuel mixture in the cylinder. Pressure produced by combustion in one cylinder is used to compress an air-fuel charge in another cylinder. Before combustion occurs while starting the engine, an actuating system is be used to compress the air-fuel charge following the expansion stroke. Motion of the pistons is controlled by a system, which synchronizes piston reciprocation, compression of the air-fuel mixture, and its combustion. Piston displacement and velocity, cylinder pressure, and the compression ratio are monitored and controlled by the system, which periodically corrects deviations from desired, synchronized reciprocation of the pistons.

While starting a free piston engine, the pistons are displaced by a starter-actuator system using hydraulic, pneumatic or electric actuation. Preferably, electric energy is used to actuate the pistons when starting an engine that produces electric output, and hydraulic or pneumatic energy is used to actuate the pistons when starting an engine that produces hydraulic or pneumatic output. When starting a free piston operating under compression ignition, a large compression ratio of the fuel-air charge in the combustion cylinder is required to produce combustion. When conventional engine starting techniques are used, a large magnitude of energy is required to produce the compression ratio required to start the engine, especially under cold starting conditions.

If the pistons are driven entirely by an actuator before combustion while starting the engine, a large magnitude of energy is required to compress the mixture of fuel and air in the combustion chamber, particularly when cold starting a compression ignition free piston engine in cold weather. A technique is required to avoid the need for a large capacity energy source to start the engine.

SUMMARY OF THE INVENTION

A free piston engine to which this invention may be applied includes axially-aligned cylinders, an inner pair of mutually connected pistons, and an outer pair of mutually connected pistons. One piston of each piston pair reciprocates in a first cylinder; the other piston of each pair reciprocates in a second cylinder. Each cylinder is formed with inlet ports, through which air enters the cylinder, exhaust ports, through which exhaust gas leaves the cylinder, and a fuel port, through which fuel is admitted, usually by injection, into the cylinder. Movement of the pistons in one cylinder, caused by combustion of a fuel-air mixture there, forces the pistons in the other cylinder to compress a fuel-air mixture in the second cylinder and to cause combustion of that mixture. In this way, the piston pairs reciprocate in the cylinders in mutual opposition, one piston pair moving longitudinal in one direction while the pistons of the other pair move in the opposite direction. When combustion occurs in a cylinder, the directions of movement of each piston pair reverse producing a compression stroke in the other cylinder.

When the engine stops, the pistons can be at any position in the cylinder. A free piston engine typically has no inlet valves or exhaust valves to control the flow of air and exhaust gas into and from the cylinder. Instead, a turbocharger driven by engine exhaust supplies pressurized air to the inlet. If the engine is stopped with a piston in the compression stroke, leakage of the air charge from the cylinder through the inlet and exhaust ports and across the piston rings will occur during the shutdown period due to the pressure in the cylinder. This leakage can produce a partial vacuum in the cylinder.

To avoid relying on large hydraulic or pneumatic pressures in the starting actuator, a cyclic starting strategy has been developed. The pistons are reciprocated during starting with a progressively increasing displacement in order to develop a sufficient magnitude of kinetic energy in the pistons to produce combustion of the fuel-air charges. Energy applied to the pistons by a starting actuator and energy recovered from expansion of the compressed air charge before combustion occurs combine to increase the kinetic energy of the reciprocating pistons and to steadily increase pressure in the combustion chambers.

The method for starting the engine uses an actuator, such as a hydraulic or pneumatic pump-motor or an electric linear alternator-starter to move the pistons to a position where the inlet ports are opened. This ensures that air is present in a space within the cylinders that is confined during a portion of the starting procedure. That air space operates as an air spring during the starting procedure to store kinetic energy from the piston by compressing the air charge during a compression stroke to apply an air charge pressure force to the piston during an expansion stroke. The pistons reciprocate with an increasing displacement in response to the application of the actuator force and the pressure forces produced by the air spring. The spring rate of the air charges increases as the pressure of the air charge increases with piston displacement.

The actuator force is a periodic force preferably having a frequency that is the same or nearly the same as the variable natural frequency of the system, which includes the mass of the pistons, other masses reciprocating with the pistons, and the variable air spring, the compressible-expansible air charge in the combustion chamber. When piston displacement reaches a sufficient magnitude, fuel is admitted to the cylinder, preferably by injection. The actuator continues to increase piston displacement and pressure of the air-fuel mixture in the cylinder until sustained cyclic combustion of that mixture occurs. Instead of immediately placing load on the engine after combustion in the first cylinder occurs, a period of delay occurs before placing full load on the engine. Force produced by the actuator can continue to be applied to the pistons or removed from the pistons while combustion continues in the first cylinder. During the delay period, fuel is admitted cyclically to the second cylinder while the piston in the second cylinder reciprocates. After sustained cyclic combustion of the fuel-air mixture in the second cylinder occurs, full load can be placed on the engine.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
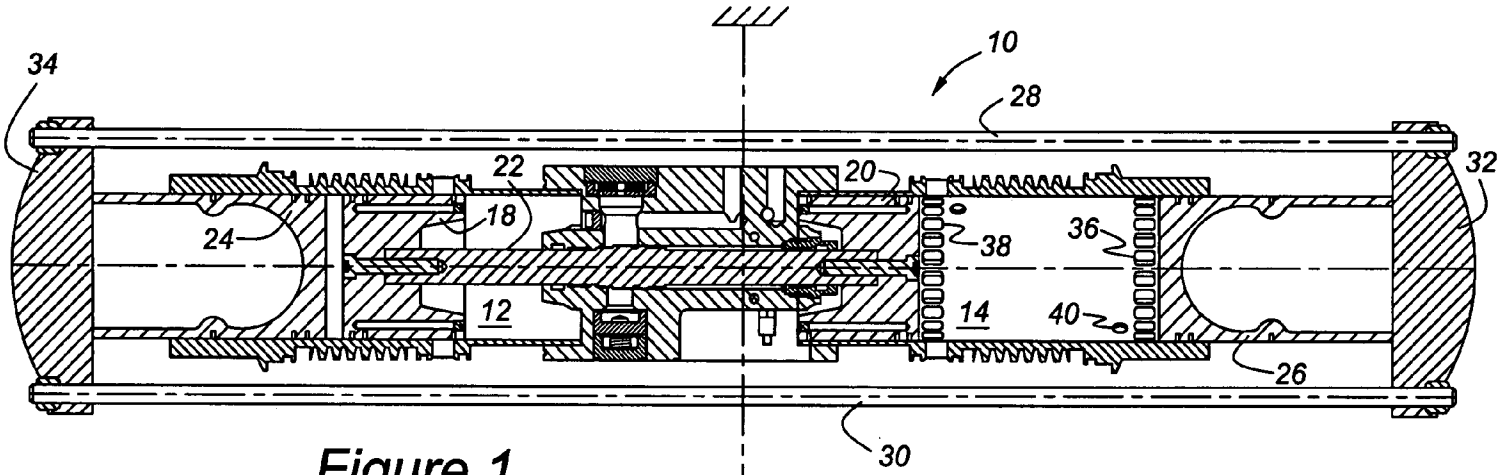
FIGS. 1 and 2 are cross sectional views taken at a longitudinal plane through a free piston engine showing schematically the position of piston pairs and combustion cylinders at opposite ends of their displacement.
Figure 2:
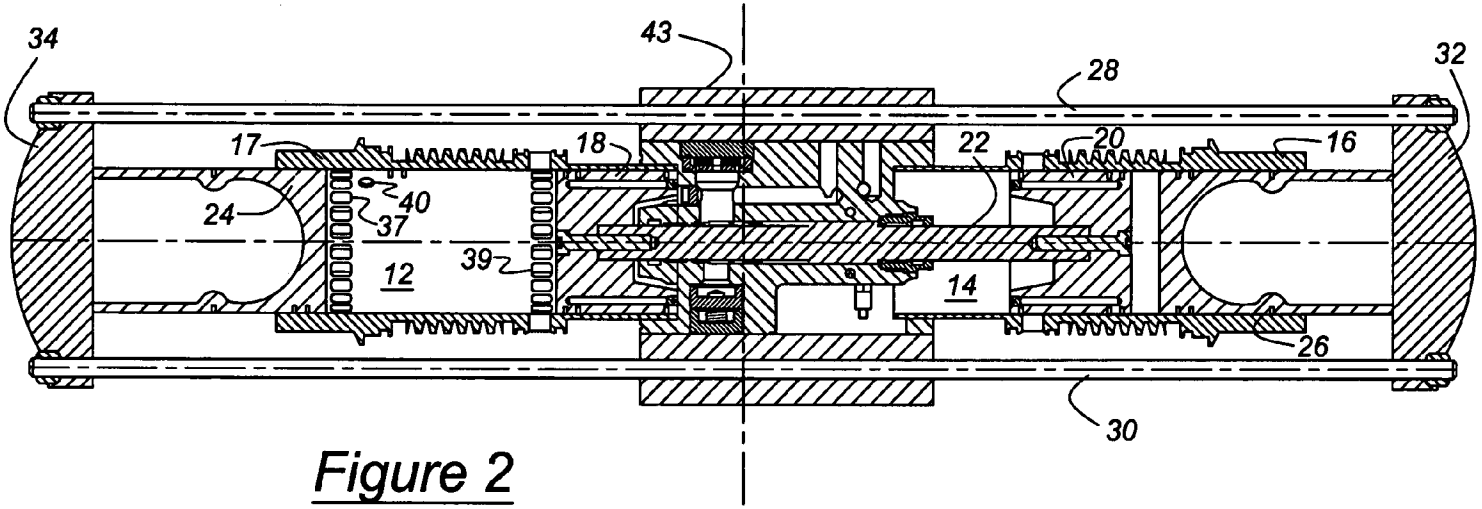

Referring first to FIGS. 1 and 2, a free piston engine 10 includes a first cylinder 12 and a second cylinder 14, axially aligned with the first cylinder, the cylinders being located in cylinder liners 16, 17, surrounded by an engine block. A first pair of pistons, inner pistons 18, 20, are mutually connected by a push rod 22. A first piston 18 of the first piston pair reciprocates within the first cylinder 12, and the second piston 20 of the first piston pair reciprocates within the second cylinder 14. A second pair of pistons, outer piston 22, 24, are connected mutually by pull rods 28, 30, and secured mutually at the axial ends of pistons 24, 26 by bridges 32, 34. A first piston of the second or outer piston pair reciprocates within the first cylinder 12, and a second piston 26 of the outer piston pair reciprocates within the first cylinder 14. Each cylinder 12, 14 is formed with air inlet ports 36, 37 and exhaust ports 38, 39. In FIG. 1, the ports 37, 39 of cylinder 12 are closed by pistons 18, 24, which are shown located near their top dead center (TDC) position, and the ports 36, 38 of cylinder 14 are opened by pistons 18, 24, which are shown located near their bottom center (BDC) position. In FIG. 2, ports 36, 38 of cylinder 14 are closed by pistons 20, 26, which are shown there located near their TDC position, and the ports 37, 39 of cylinder 12 are opened by pistons 18, 24, which are shown there located near their BDC position. When the pistons of either cylinder are at the TDC position, the pistons of the other cylinder are at or near their BDC position. Each cylinder is formed with a fuel port 40, through which fuel is admitted, preferably by injection, into the cylinder during the compression stroke.

Displacement of the piston pairs between their respective TDC and BDC positions, the extremities of travel shown in FIGS. 1 and 2, is coordinated such that a fuel-air mixture located in the space between pistons 18, 24 in cylinder 12 and between pistons 20, 26 in cylinder 14 is compressed. Combustion of those mixtures occurs within the cylinders, preferably when the pistons have moved slightly past the TDC position toward the BDC position. This synchronized reciprocation of the piston pairs is referred to as "opposed piston-opposed cylinder" (OPOC) reciprocation.

Figure 3:
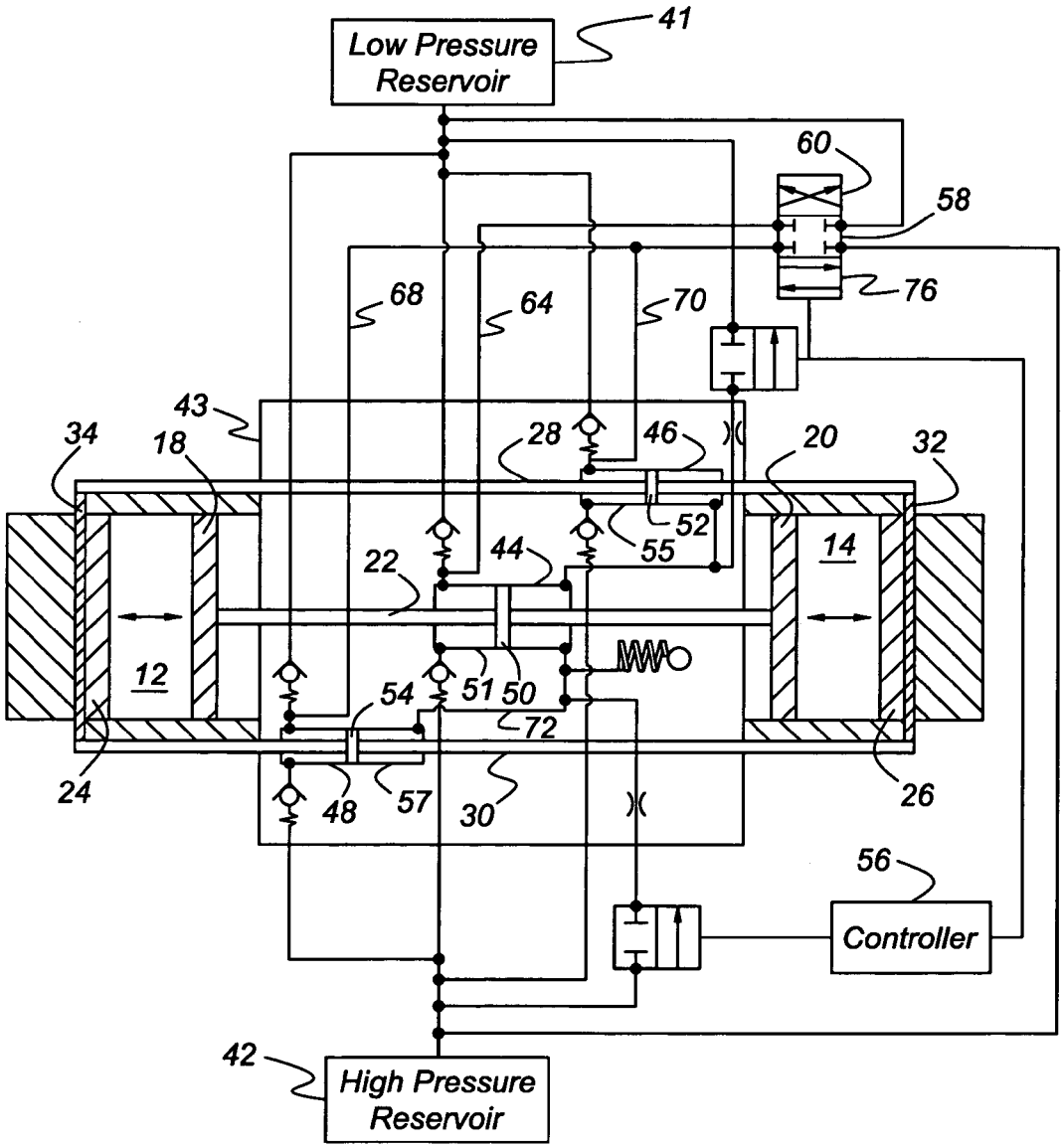
FIG. 3 is a schematic diagram of a fluid control system having a controller for operating fluid pump-motors connected to the engine piston pairs for starting the engine.
Figure 4A:
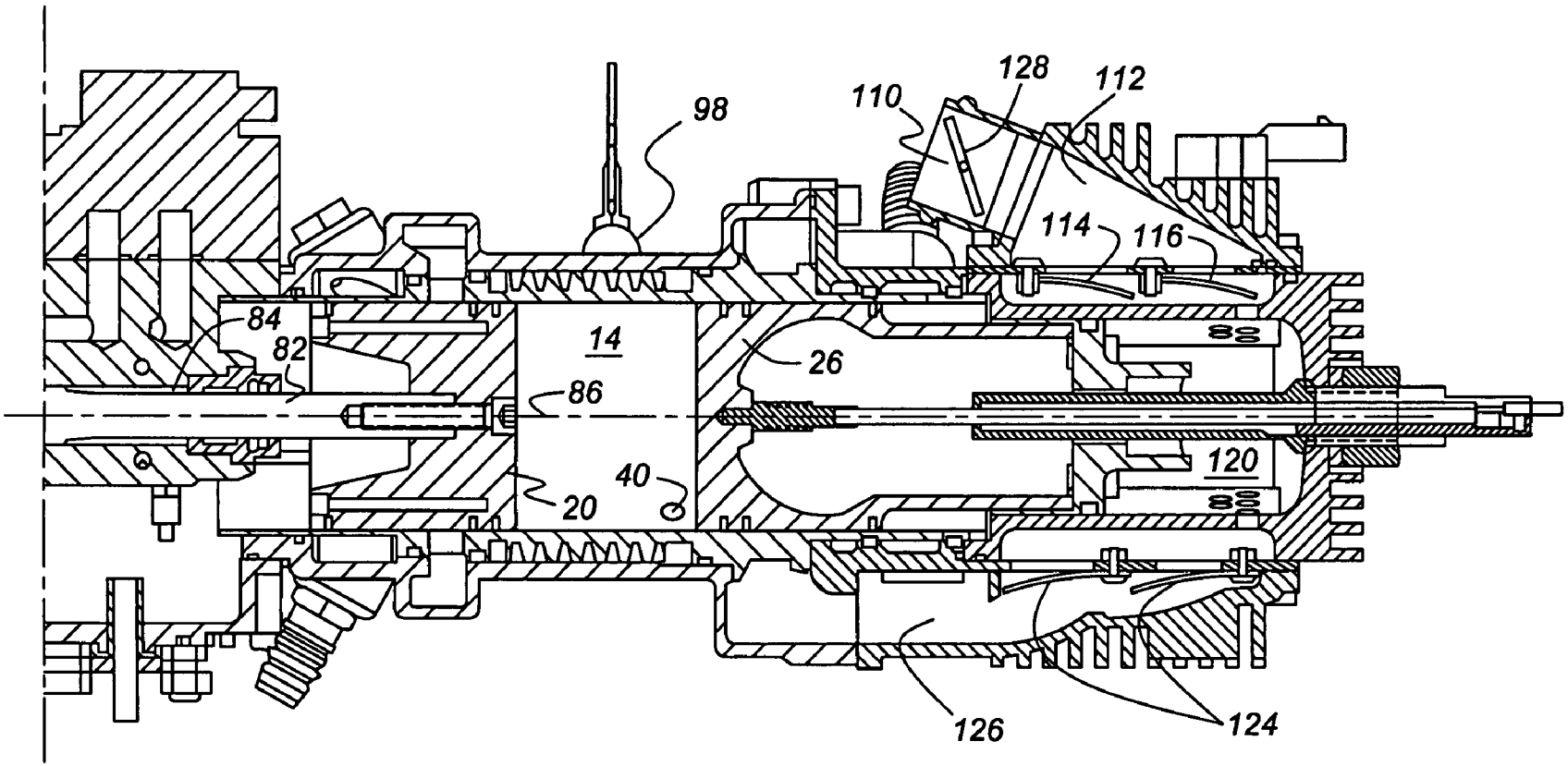
FIGS. 4A and 4B are a cross section taken along a longitudinal plane of an engine and hydraulic motor-pump assembly.
Figure 4B:
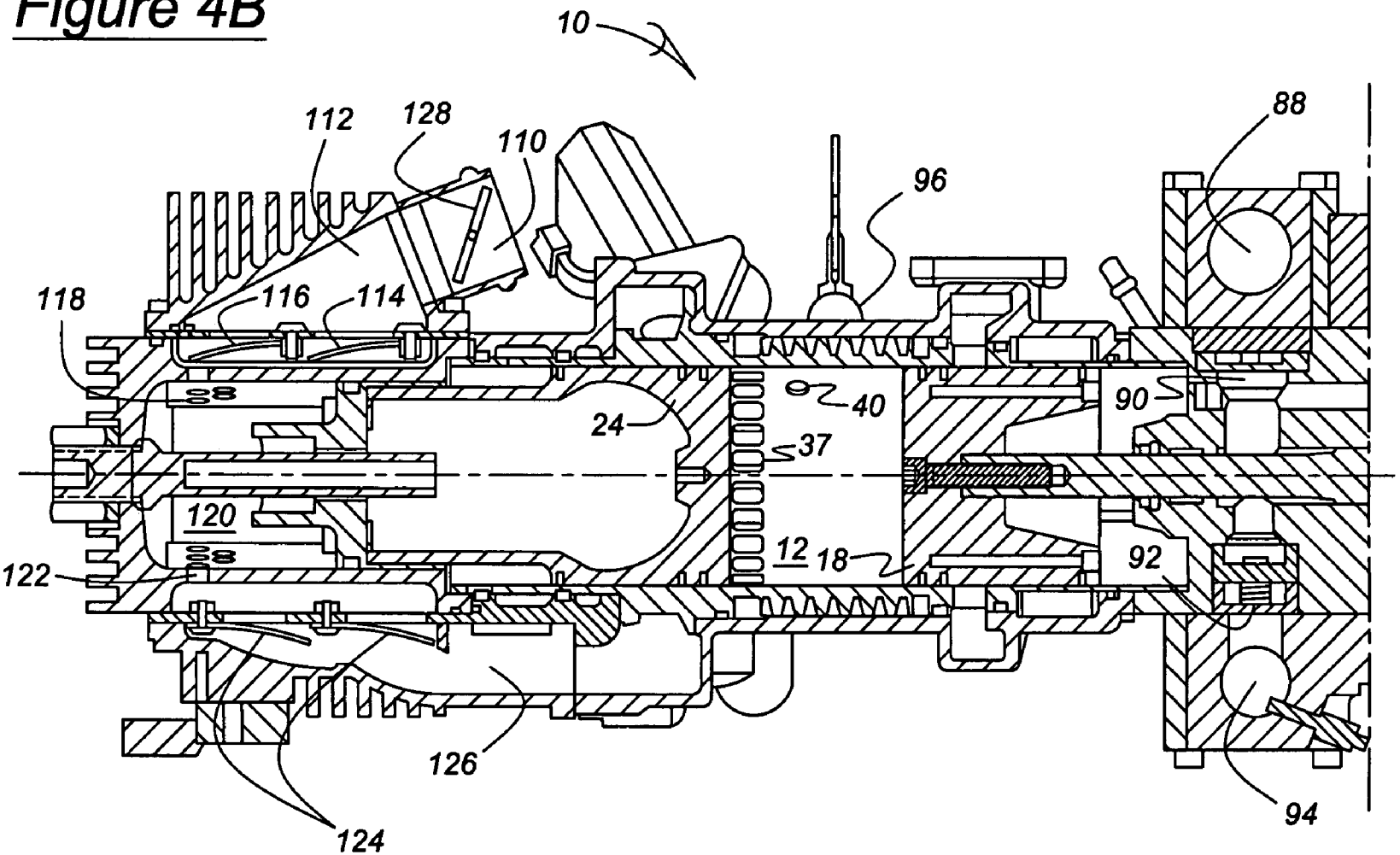
Figure 5:
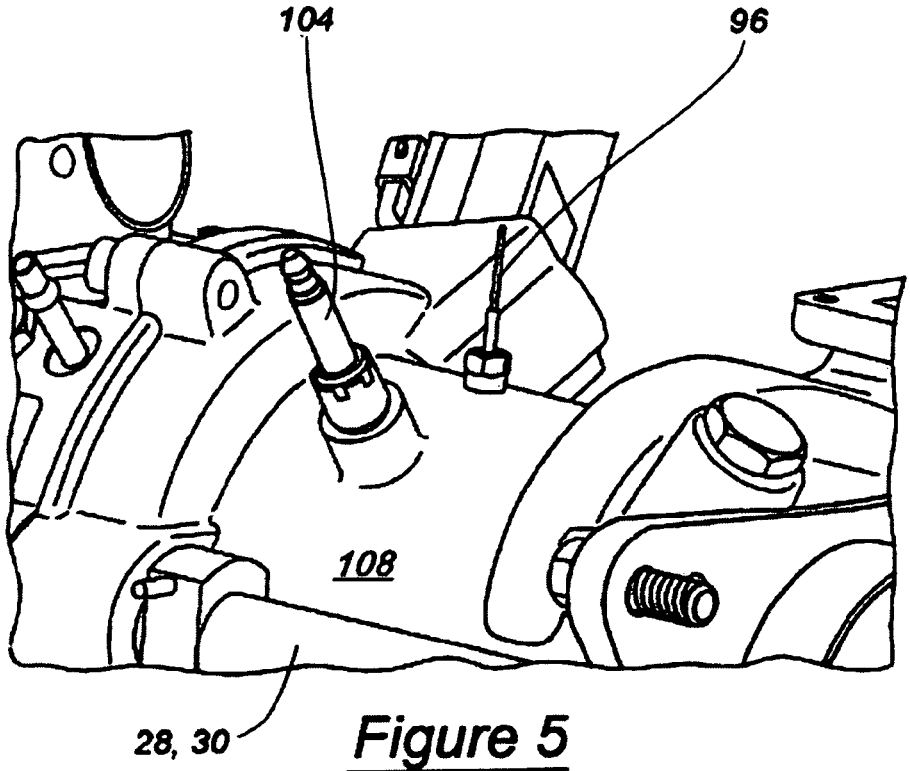
FIG. 5 is an isometric view of a portion of the outer surface of the engine of FIG. 1.
Figure 6:
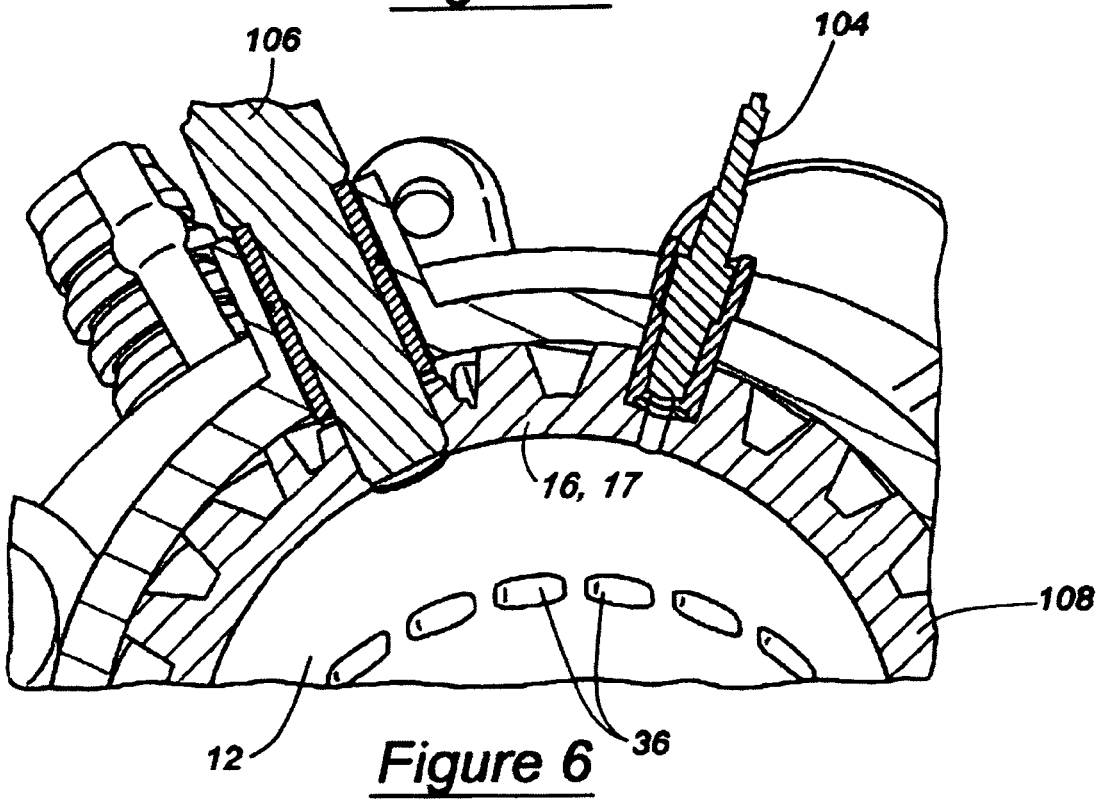
FIG. 6 is a partial transverse cross section of the engine of FIG. 1 taken at the location of a spark plug or a glow plug.

The synchronized, coordinated movement of the pistons is controlled through a hydraulic circuit, which includes fluid motor-pumps check valves and lines contained in a hydraulic or pneumatic block 43, located axially between the cylinder sleeves 16, 17. Referring next to FIG. 3, the control circuit includes a low pressure accumulator 41, a high pressure accumulator 42, a motor pump 44 driveably connected to push rod 22, a motor pump 46 driveably connected to pull rod 28, and a motor pump 48 driveably connected to pull rod 30. Push rod 22 is formed with a piston 50 located in a cylinder 51 formed in block 43. Reciprocation of engine pistons 18, 20 causes piston 50 of motor pump 44 to reciprocate. Pull rods 28, 30 are each formed with pistons 52, 54, located in cylinders 55, 57, respectively, formed in block 43. Reciprocation of engine pistons 24, 26 causes pistons 52, 54 of motor pumps 46, 48 to reciprocate.

The actuator connects high pressure accumulator 42 alternately to actuator motors 44, 46, 48 in order to displace the piston pairs 18–20, 24–26 in their respective cylinders 12, 14 against the pressure produced in the cylinders during the compression stroke. Preferably the actuator motors 44, 46, 48 apply force to the pistons when the pistons are at or near the BDC position, and the motors remove the actuating force before the piston reaches the TDC position. The pressure developed in each cylinder during its compression stroke forces the piston away from the TDC position during the expansion stroke. The increase of piston displacement for each piston displacement cycle is accomplished by progressively increasing the magnitude of the pressure applied by the actuator motors during each displacement cycle, or by increasing the length of the period when pressure is applied to the actuator, or by a combination of these actions.

When the engine 10 is running, the coordinated reciprocating movement of the engine pistons draws fluid from the low pressure accumulator 41 to the pump motors 44, 46, 48, which produce hydraulic or pneumatic output fluid flow, supplied to the high pressure accumulator 42. The motor-pumps 44, 46, 48 operate as motors driven by pressurized fluid in order to start the engine, and operate as pumps to supply fluid to the high pressure accumulator for temporary storage there or to supply fluid directly to fluid motors, which drive the wheels in rotation against a load.

An electronic controller 56 produces an actuating signal transmitted to a solenoid or a relay, which, in response to the actuating signal, changes the state of a control valve 58. For example, when the hydraulic system is operating as a motor to move the engine pistons preparatory to starting the engine, controller 56 switches valve 58 between a first state 60, at which accumulator 42 is connected through valve 58 to the left-hand side of the cylinder 51 of pump-motor 44 through line 64. With valve 58 in the state 60, the left-hand sides of the cylinders 55, 57 of motor-pumps 46, 48, are connected through lines 68, 70 and valve 58 to the low pressure accumulator 41. These actions cause piston 50 to move rightward forcing fluid from pump-motor 44 through line 72 to the right-hand side of the cylinder 57, and through line 74 to the right-hand side of cylinder 55. In this way, the first state of valve 58 causes the fluid control system to move engine pistons 18, 20 rightward and engine pistons 24, 26 to move leftward from the position shown in FIG. 3.

When controller 56 switches valve 58 to the second state 76, high pressure accumulator 42 is connected through line 68 to the left-hand side of piston 57 of motor-pump 48, and through line 70 to the left-hand side of piston 55 of motor-pump 46. This forces engine pistons 24, 26 rightward. When valve 58 is in the second state 76, the low-pressure accumulator 41 is connected through valve 58 and line 64 to the left-hand side of cylinder 51 of motor-pump 44. As pistons 52, 54 move rightward, fluid is pumped from cylinders 55, 57 through lines 74, 72, respectively, to the right-hand side of cylinder 51. This causes piston 50, push rod 22 and engine pistons 18, 20 to move leftward.

When starting the engine 10 and before fuel is injected, pistons 18, 20 are moved leftward and concurrently pistons 24, 26 are moved rightward by an actuator system, such as that described with reference to FIG. 3, toward the position shown in FIG. 1. This piston displacement is sufficient to allow the pistons to open the inlet ports 36 in cylinder 14, thereby ensuring that cylinder 14 is filled with a pneumatic charge, preferably an air charge. Next, pistons 18, 20 are moved rightward and concurrently pistons 24, 26 are moved leftward by the actuator system toward the position shown in FIG. 2. This displacement is sufficient to allow the pistons to open the inlet ports 37 in cylinder 12, thereby ensuring that cylinder 12 is filled with a pneumatic charge, preferably an air charge.

After an air charge is admitted to each cylinder, the actuator reciprocates the pistons producing compression and expansion strokes having increasing piston displacement or stroke, increasing piston speed, increasing peak pressure in the combustion chamber, increasing compression ratio of the air charge, but without allowing piston displacement to open the inlet ducts 36, 37. Cyclic compression and expansion of the air charges in cylinders 12, 14 are analogous to the effect of a compression spring located in each cylinder. Compression of the pneumatic charge in a cylinder opposes acceleration of the piston masses toward the TDC position in that cylinder. Expansion of the pneumatic charge in a cylinder assists in accelerating the piston masses toward the BDC position in that cylinder. As the charge in one cylinder is being compressed, the charge in the other cylinder is expanding. Therefore, pressure forces are continually developed that assist the pistons in each cylinder to move alternately toward the TDC and BDC positions in the correct phase relationship.

To restart a hot or warm engine, it is expected that only one or two cycles of compression and expansion strokes will be required after admitting the air charges to the cylinders and before subsequent engine starting steps are performed. To start a cold engine, it is expected that about ten such cycles will be required after admitting the air charge and before additional engine starting steps are performed.

Next, a volume of fuel to be added to each air charge during a first series of cycles while starting the engine with spark ignition is determined. Throttle valves 128 are used to establish a flow rate of air into the cylinders through the inlet ports 36, 37 during a first series of starting cycles. Fuel is admitted to the cylinders through fuel ports 40 such that a stoichiometric mixture of fuel and air, or a mixture that is approximately stoichiometric, is present in the cylinders. Either spark plug 104 or glow plug 106 produces ignition. Combustion of the fuel-air mixture in the cylinders 12, 14 at the correct phase relation to the peak pressure occurs. After the engine begins to run under spark ignition, the actuator stops driving the pistons, and the engine operates independently of the starter-actuator. The engine controller causes the fuel injectors 100, 102 to inject fuel repetitively in an appropriate quantity of fuel thorough fuel ports 40 into the combustion chambers located between the pistons in each cylinder 12, 14.

The peak pressure in each cylinder is monitored by pressure sensors 96, 98. The controller 56 determines whether the peak pressure during spark ignition occurs when the pistons are at the TDC position in the combustion cylinder, or within a predetermined period or distance after the TDC position. The period is preferably about 0.25 ms. after TDC, or a delay comparable to 2° after TDC for a two stroke, crankshaft internal combustion engine supplied with a comparable fuel, such as gasoline. The controller 56 adjusts the spark ignition timing until the peak pressure occurs within an acceptable phase range.

When ignition occurs at an acceptable phase relation to the peak pressure, a second series of engine starting cycles begins. During these engine cycles, the air-fuel ratio in the cylinders is reduced by using the throttle valves 128 to increase the air flow rate supplied to the cylinders, or by using the fuel injectors 100, 102 to reduce the fuel flow rate to the cylinders, or by using both the throttle valves and fuel injectors to increase the air flow rate and reduce the fuel flow rate. The spark ignition system is turned off by the engine controller 56. Thereafter, the engine operates preferably with a homogenous air-fuel charge and combustion occurs by compression ignition. After the engine starts and continues to run under programmed control, and an external load can be placed on the engine.

An engine controller causes a fuel injector 100 to inject an appropriate quantity of fuel into cylinder 12 between pistons 18, 24 through fuel port 40. After the engine starts, it continues to run under programmed control with fuel injection being actively controlled by the engine controller.

The actuator force is a periodic force preferably having a frequency that is the same or nearly the same as the variable natural frequency of the system being reciprocated, which includes the mass of the pistons, other masses connected to and reciprocating with the pistons, and the variable air spring, the compressible-expansible air charge in the combustion chamber. When piston displacement reaches a sufficient magnitude, fuel is admitted to the cylinder, preferably by injection. The actuator continues to increase piston displacement and pressure of the air-fuel mixture in the cylinder until sustained cyclic combustion of that mixture occurs. Instead of immediately placing load on the engine after combustion in the first cylinder occurs, a period of delay occurs before placing full load on the engine. Force produced by the actuator can continue to be applied to the pistons or removed from the pistons while combustion continues in the first cylinder and before sustained combustion in the second cylinder occurs. During the delay period, fuel is admitted cyclically to the second cylinder while the piston in the second cylinder reciprocates. After sustained cyclic combustion of the fuel-air mixture in the second cylinder occurs, full load can be placed on the engine. After the engine starts, it continues to run under programmed control with fuel injection being actively controlled by an engine controller.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method for starting a free piston internal combustion engine that includes a first pair of mutually connected pistons, a second pair of mutually connected pistons, a first piston of each pair located in a first cylinder, a second piston of each pair located in a second cylinder, the method comprising the steps of:

supplying an air charge to a closed space in the cylinders;

reciprocating the pistons and cyclically increasing a pressure of an air charge during successive cycles to a predetermined magnitude;

cyclically admitting air and fuel to the first cylinder to produce repetitively a fuel-air mixture in the first cylinder;

producing cyclic combustion of the mixture in the first cylinder;

delaying application of at least a portion of an external load on the engine;

cyclically admitting air and fuel to the second cylinder to repetitively produce a fuel-air mixture in the second cylinder; and producing cyclic combustion of the mixture in the second cylinder.

2. The method of claim 1, further comprising:

discontinuing the step of delaying when combustion in the first and second cylinders is sustained for a predetermined period.

3. The method of claim 1, wherein the step of reciprocating the pistons, further comprises the step of:

applying a periodic force to the pistons tending to compress an air charge during a compression stroke in the first cylinder and tending to expand an air charge during an expansion stroke in the second cylinder.

4. The method of claim 1, wherein the step of reciprocating the pistons, further comprises the steps of:

applying a periodic force to the pistons tending to compress an air charge during a compression stroke in the first cylinder and tending to expand an air charge during an expansion stroke in the second cylinder; and applying a periodic force to the pistons tending to compress an air charge during a compression stroke in the second cylinder and tending to expand an air charge during an expansion stroke in the first cylinder.

5. The method of claim 1, wherein the step of reciprocating the pistons, further comprises:

determining a first magnitude of maximum cyclic pressure in the first cylinder at which compression combustion of the fuel-air mixture in the first cylinder will occur; and increasing a cyclic displacement of the pistons such that said first magnitude of pressure is produced in the first cylinder.

6. The method of claim 1, wherein the step of cyclically admitting fuel to the first cylinder further comprises:

repetitively injecting fuel cyclically to produce a fuel-air mixture in the first cylinder.

7. The method of claim 1, wherein the step of producing cyclic combustion of the mixture in the first cylinder further comprises:

using combustion ignition to produce cyclic combustion of the mixture in the first cylinder.

8. The method of claim 1, wherein the step of producing cyclic combustion of the mixture in the first cylinder further comprises:

using spark ignition to produce cyclic combustion of the mixture in the first cylinder.

9. The method of claim 1, wherein the step of producing cyclic combustion of the mixture in the first cylinder further comprises:

using spark ignition to produce cyclic combustion of the mixture in the first cylinder; and using combustion ignition to produce cyclic combustion of the mixture in the first cylinder after combustion of the mixture in the first cylinder is produced by spark ignition.

10. The method of claim 1, wherein the step of producing cyclic combustion of the mixture in the second cylinder further comprises:

using spark ignition to produce cyclic combustion of the mixture in the second cylinder; and using combustion ignition to produce cyclic combustion of the mixture in the first cylinder after combustion of the mixture in the second cylinder is produced by spark ignition.

11. A method for starting a free piston internal combustion engine that includes a first pair of mutually connected pistons, a second pair of mutually connected pistons, and a actuator for displacing the pistons, a first piston of each pair located in a first cylinder, a second piston of each pair located in a second cylinder, each cylinder having a inlet port through which air enters the cylinder, the method comprising the steps of:

using the actuator to displace the pistons sufficiently to open the inlet ports and supply an air charge to a closed space in each cylinder;

using the actuator to reciprocate the pistons cyclically and to increase a maximum pressure of an air charge produced during successive cycles to a predetermined magnitude;

cyclically admitting air and fuel to the first cylinder to produce repetitively a fuel-air mixture in the first cylinder;

producing cyclic combustion of the mixture in the first cylinder;

delaying application of at least a portion of an external load on the engine;

cyclically admitting air and fuel to the second cylinder to repetitively produce a fuel-air mixture in the second cylinder; and producing cyclic combustion of the mixture in the second cylinder.

12. The method of claim 11, further comprising:

discontinuing the step of delaying when combustion in the first and second cylinders is sustained for a predetermined period.

13. The method of claim 11, wherein the step of using the actuator to reciprocate the pistons, further comprises the step of:

using the actuator to apply a periodic force to the pistons tending to compress an air charge during a compression stroke in the first cylinder and tending to expand an air charge during an expansion stroke in the second cylinder.

14. The method of claim 11, wherein the step of using the actuator to reciprocate the pistons, further comprises the steps of:

using the actuator to apply a periodic force to the pistons tending to compress an air charge during a compression stroke in the first cylinder and tending to expand an air charge during an expansion stroke in the second cylinder; and using the actuator to apply a periodic force to the pistons tending to compress an air charge during a compression stroke in the second cylinder and tending to expand an air charge during an expansion stroke in the first cylinder.

15. The method of claim 11, wherein the step of using the actuator to reciprocate the pistons, further comprises:

determining a first magnitude of maximum cyclic pressure in the first cylinder at which compression combustion of the fuel-air mixture in the first cylinder will occur; and using the actuator to increase a maximum cyclic displacement of the pistons such that said first magnitude of pressure is produced in the first cylinder.

16. The method of claim 11, wherein the step of cyclically admitting fuel to the first cylinder further comprises:

repetitively injecting fuel cyclically to produce a fuel-air mixture in the first cylinder.

17. The method of claim 11, wherein the step of producing cyclic combustion of the mixture in the first cylinder further comprises:

using combustion ignition to produce cyclic combustion of the mixture in the first cylinder.

18. The method of claim 11, wherein the step of producing cyclic combustion of the mixture in the first cylinder further comprises:

using spark ignition to produce cyclic combustion of the mixture in the first cylinder.

19. The method of claim 11, wherein the step of producing cyclic combustion of the mixture in the first cylinder further comprises:

using spark ignition to produce cyclic combustion of the mixture in the first cylinder; and using combustion ignition to produce cyclic combustion of the mixture in the first cylinder after combustion of the mixture in the first cylinder is produced by spark ignition.

20. The method of claim 11, wherein the step of producing cyclic combustion of the mixture in the second cylinder further comprises:

using spark ignition to produce cyclic combustion of the mixture in the second cylinder; and using combustion ignition to produce cyclic combustion of the mixture in the first cylinder after combustion of the mixture in the second cylinder is produced by spark ignition.

21. The method of claim 11, wherein the steps of using the actuator further comprise:

providing one of an electric, pneumatic, and hydraulic energy source to drive the actuator that displaces and reciprocates the pistons.

* * * * *